US005195445A

United States Patent [19]

Riddles et al.

[11] Patent Number: 5,195,445

[45] Date of Patent: Mar. 23, 1993

[54] COMPANIONWAY ENCLOSURE ASSEMBLY

[76] Inventors: Marilyn S. Riddles; Steven W. Riddles, both of Rte. 1, Box 59B, Edmond, Okla. 73034

[21] Appl. No.: 862,193

[22] Filed: Apr. 2, 1992

[51] Int. Cl.[5] ..... B63B 19/12

[52] U.S. Cl. ..... 114/201 R; 114/361; 114/343

[58] Field of Search .... 114/343, 361, 364, 201 R-203, 114/173-178, 211; 160/210, 349.1, 352, 230, 231.1, 231.2, 215, 181, 186, 218, 219

[56] References Cited

U.S. PATENT DOCUMENTS 1,198,579 9/1916 Rich ..... 160/210
2,086,091 7/1937 Payette ..... 160/210
3,018,784 1/1962 Buxman .
5,003,905 4/1991 Raynor ..... 115/201 R

*Primary Examiner*—Edwin L. Swinehart
*Attorney, Agent, or Firm*—Glen M. Burdick

[57] ABSTRACT

A companionway enclosure assembly is provided for enclosing the companionway of a boat. The companionway enclosure assembly comprises a flexible cover, a support rod, a weight member, and a plurality of fastening assemblies. The flexible cover is extendible over the companionway and is supported and maintained in a stretched out condition over a companionway by the support rod which traverses the width of the flexible cover and by the weight member. The fastening assemblies secure the companionway enclosure to the boat and further maintain the flexible cover in a stretched out condition.

11 Claims, 4 Drawing Sheets

COMPANIONWAY ENCLOSURE ASSEMBLY

BACKGROUND OF THE INVENTION

1. Field of the Invention

The present invention relates generally to boating and sailing, and more particularly, but not by way of limitation, to an enclosure assembly for a companionway of a boat.

2. Description of the Prior Art

In boats having cabin accommodations, the cabin usually lies below the upper deck and is covered with a raised cabin trunk to give more headroom to occupants of the cabin. Entry into the cabin from the upper deck of the boat is gained via a companionway which is a stairway located at the rear end of the cabin trunk. Companionways consist of an open top or hatch portion and an open side portion, thereby enabling a person of average size to easily enter and exit the cabin while maintaining a substantially upright posture.

Companionways are commonly closed by using a sliding hatch cover in combination with washboards or wooden partitions. The hatch cover is slidably mounted on top of the cabin trunk adjacent the companionway hatch so as to be movable over the companionway hatch, as desired, and the side portion of the companionway is closed by inserting washboards or partitions into slots disposed along the sides and bottom of the companionway.

The use of a hatch cover and partitions for closing the companionway poses several problems for boaters and sailors. For instance, when the companionway is open, passage to and from the cabin in unimpeded. However, passage for insects, such as mosquitoes, is also unimpeded thus enabling them to freely infest the cabin. Also, with the companionway open, privacy for one in the cabin is at a minimum. In contrast, when the companionway is closed with the hatch cover and partitions, insects are better controlled and a degree of privacy is maintained. However, passage to and from the cabin becomes very inconvenient since the hatch cover must be slid open and the partitions lifted and removed from their slots in order for one to pass to or from the cabin. These steps must be repeated in reverse order to once again enclose the companionway. The opening and closing of the companionway becomes even more inconvenient when coupled with the awkward size and substantially weight of many partitions and hatch covers.

Another problem encountered with the use of partitions or washboards to enclosed the companionway is that they do not provide an adequate barrier against the wind and cold since the partitions often do not fit tightly together, thus making for uncomfortable conditions in the cabin of the boat during periods of cold or inclement weather. On the other hand, during warm weather the use of partitions does not allow air to adequately circulate through the cabin.

Yet another problem with the use of partitions is that the partitions become weathered as a result of constant exposure to elements, such as sun, wind and rain. This is particularly true when the boat is stored. Under such conditions, the finish on the partitions becomes dull, unattractive and deteriorates which results in water being able to seep into the partitions and cause them to deteriorate. To alleviate this problem, boat owners often cover the partitions with a sheet of plastic while storing the boat; however, the plastic sheet often gets torn or blows away leaving the partitions exposed to the elements.

Thus, it becomes clear that a need has long existed for a companionway enclosure assembly which is easy to handle; which will allow for each access to and from the cabin; while also providing a substantially degree of privacy and a barrier from insects and the weather; and which can be used to protect the hatch cover and partitions when same are in place during storage of the boat. It is to such a companionway enclosure assembly that the present invention is directed.

SUMMARY OF THE INVENTION

According to the present invention a companionway enclosure assembly is provided for enclosing the companionway of a boat wherein the companionway is characterized as having a top or hatch portion and a side portion. Broadly, the companionway enclosure assembly comprises a flexible cover having an awning portion extendible over the hatch portion of the companionway and a door portion extendible over the side portion of the companionway. A support rod, traversing the width of the flexible cover and separating the awning portion from the door portion, is provided to support and maintain the flexible cover in a stretched or extended position when the flexible cover is disposed in a covering position over the companionway. The door portion of the flexible cover is maintained in the stretched or extended position by a weight member attached to a lower end portion of the door portion. A plurality of fastening assemblies secure the flexible cover to the boat in a manner which also maintains the awning portion in a stretched or extended position.

An object of the present invention is to provide a companionway enclosure assembly for the companionway of a boat.

Another object of the present invention, while achieving the before-stated object, is to provide a companionway enclosure assembly which permits easy access to and from the cabin of a boat.

Yet another object of the present invention, while achieving the before-stated objects, is to provide a companionway enclosure assembly which insulates the cabin of a boat from rain, wind, and cold.

Another object of the present invention, while achieving the before-stated objects, is to provide a companionway enclosure assembly which permits circulation of air through the cabin of a boat while also acting as a barrier against insects.

Still yet another object of the present invention, while achieving the before-stated objects, is to provide a companionway enclosure assembly which is light weight, easy to handle, economical to manufacture, and durable in construction.

Other objects, advantages and features of the present invention will be apparent to those skilled in the art from the following detailed description when read in conjunction with the drawings and appended claims.

DETAILED DESCRIPTION

Figure 1:
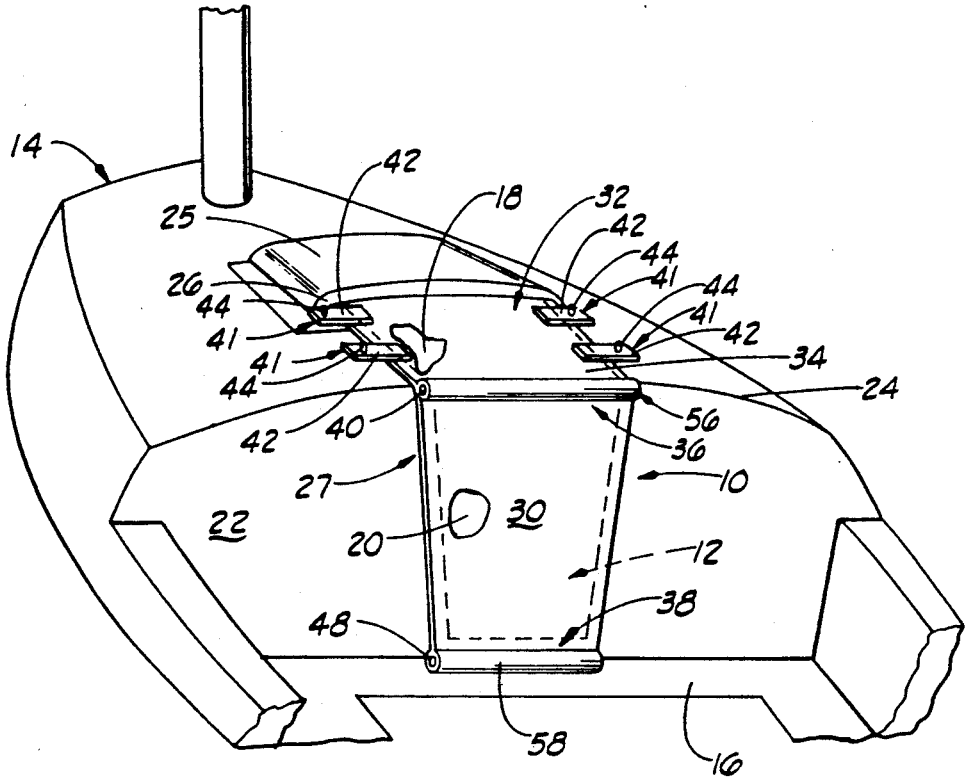
FIG. 1 is a partially cutaway, perspective view of a companionway enclosure assembly constructed in accordance with the present invention illustrating the companionway enclosure assembly extended over and enclosing the companionway of a sail boat, only a portion of the sail boat being depicted.

Referring now to the drawings, and more specifically to FIG. 1, shown is a companionway enclosure assembly 10 constructed in accordance with the present invention. The companionway enclosure assembly 10 is illustrated covering a companionway 12 of a boat 14 (partially shown). As mentioned hereinabove, the companionway 12 is a stairway for an upper deck 16 of the boat 14 to a cabin (not shown), and the companionway 12 has a hatch portion 18 and a side portion 20 for easy access to and from the cabin. The cabin is covered by a raised cabin trunk 22 to provide sufficient headroom for occupants of the cabin. The companionway 12 is usually located at a rear end 24 of the cabin trunk 22 and is normally enclosed with a sliding hatch cover 25 having a rear end 26 together with several washboards or wood partitions (not shown) which are held in place by insertion into slots or grooves (also not shown) disposed on the sides and bottoms of the companionway 12.

Figure 2:
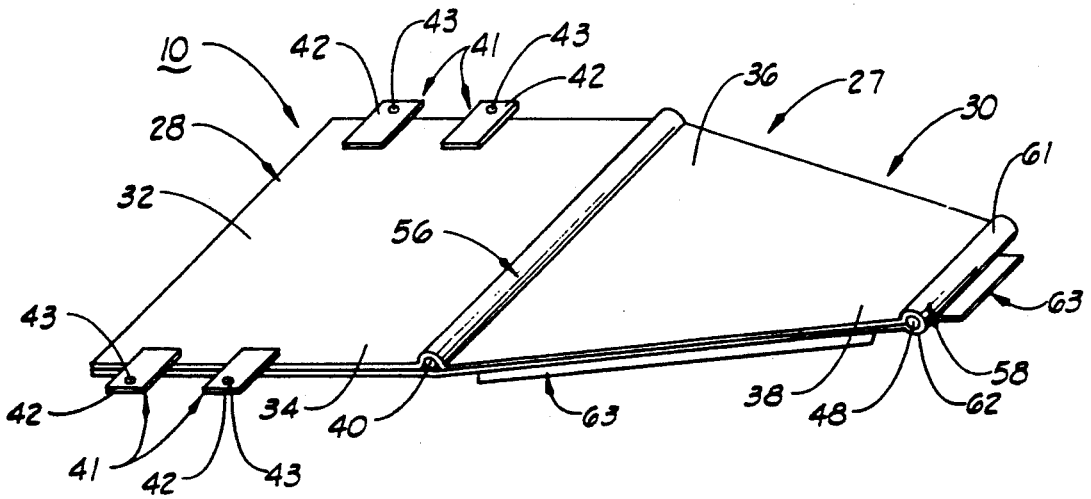
FIG. 2 is a perspective view of the companionway enclosure assembly of the present invention in an extended position.

Referring more specifically to FIG. 2, the companionway enclosure assembly 10, which primarily functions as an insulating device from rain, wind and cold, is characterized as a flexible cover 27 comprising an awning portion 28 and a door portion 30. The awning portion 28 is characterized as having a first end 32 and a second end 34; and the door portion 30 is also characterized as having a first end 36 and a second end 38. The awning portion 28 is substantially rectangularly shaped and dimensioned so as to be extendible over the similarly shaped hatch portion 18 of the companionway 12; whereas, the door portion 30 is substantially trapazoidally shaped and dimensioned so as to be extendible over the similarly shaped side portion 20 of the companionway 12.

The awning portion 28 and the door portion 30 of the companionway enclosure assembly 10 are separated by a support rod 40 which traverses the width of the companionway enclosure assembly 10 so that the ends of the support rod 40 rest against the cabin trunk 22, thereby supporting and maintaining the awning portion 28 of the flexible cover 27 in an extended position over the hatch portion 18 of the companionway 12 substantially as shown in FIG. 1 The positioning of the support rod 40 relative to the hatch portion 18 and the side portion 20 of the companionway 12 is important for maintaining the awning portion 28 of the flexible cover 27 in a stretched, covering position as will be described in detail hereinafter.

The companionway enclosure assembly 10 is secured to the cabin trunk 22 so that the flexible cover 27 encloses the companionway 12, while at the same time permitting easy access to the cabin (not shown) of the boat 14. That is, the flexible cover 27 can be disposed in a companionway closing position (FIG. 1); or the flexible cover 27 can be disposed on the cabin trunk 22 so that substantially unrestricted access is provided to the cabin of the boat 14 via the companionway 12.

Figure 7:
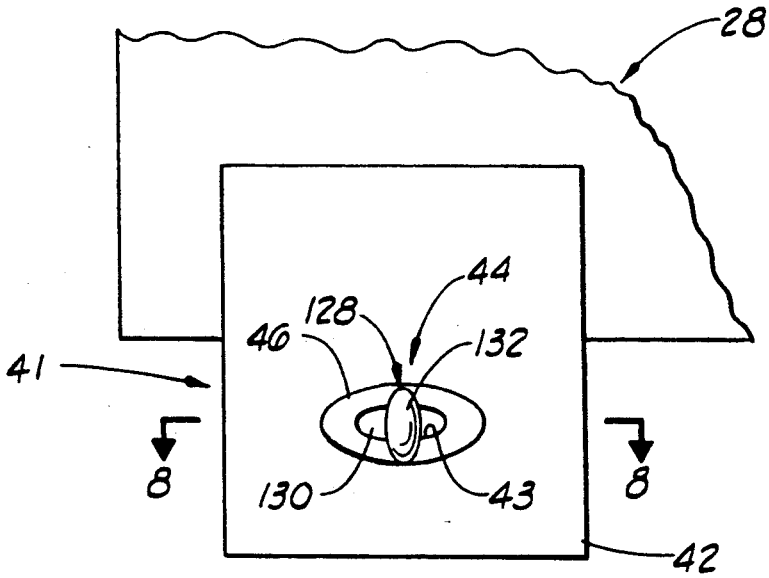
FIG. 7 is an enlarged, fragmental top plan view of a portion of the companionway enclosure of FIG. 2 illustrating a fastening flap secured by a turnbutton.
Figure 8:
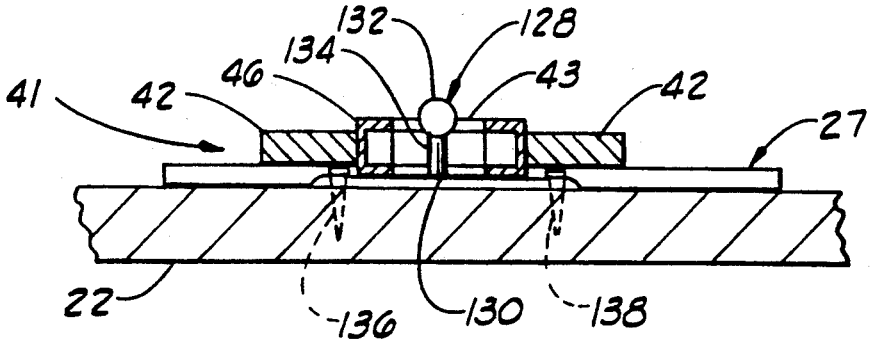
FIG. 8 is a fragmental cross-sectional view of the fastener flap of FIG. 7 taken along the line 8-8.

To secure the flexible cover 27 to the cabin trunk 22, the companionway enclosure assembly 10 is provided with a plurality of connector assemblies 41. Each of the connector assemblies 41 includes a connector flap 42 having a latch hole 43 disposed therethrough adapted to receive a latching member 44 substantially as shown in FIGS. 1, 7 and 8. A reinforcing element 46 (FIGS. 7 and 8) is disposed about the latch hole 43 to maintain the shape and dimension of the latch hole 43. The connector flaps 42 are attached to the awning portion 28 of the flexible cover 27 such that the latch hole 43 extends over the edge of the flexible cover 27 substantially as shown in FIGS. 2 and 7. The connector flaps 42 can be fabricated as an integral portion of the flexible cover 27, or the connector flaps 42 can be fabricated as separate elements and can be secured to the awning portion 28 of the flexible cover 27 by any suitable means, such as by sewing and the like.

The connector flaps 42 are connected to the cabin trunk 22 adjacent the hatch portion 18 of the companionway 12 by the latching members 44 which are mounted to a top portion of the cabin trunk 22 adjacent the hatch portion 18. The latching members 44 can be any suitable device capable of connecting the awning portion 28 of the flexible cover 27 to the cabin trunk 22. However, desirable results have been obtained where the latching members 44 are conventional turnbuttons as will be described in further detail hereinafter with reference to FIGS. 7 and 8.

Figure 3:
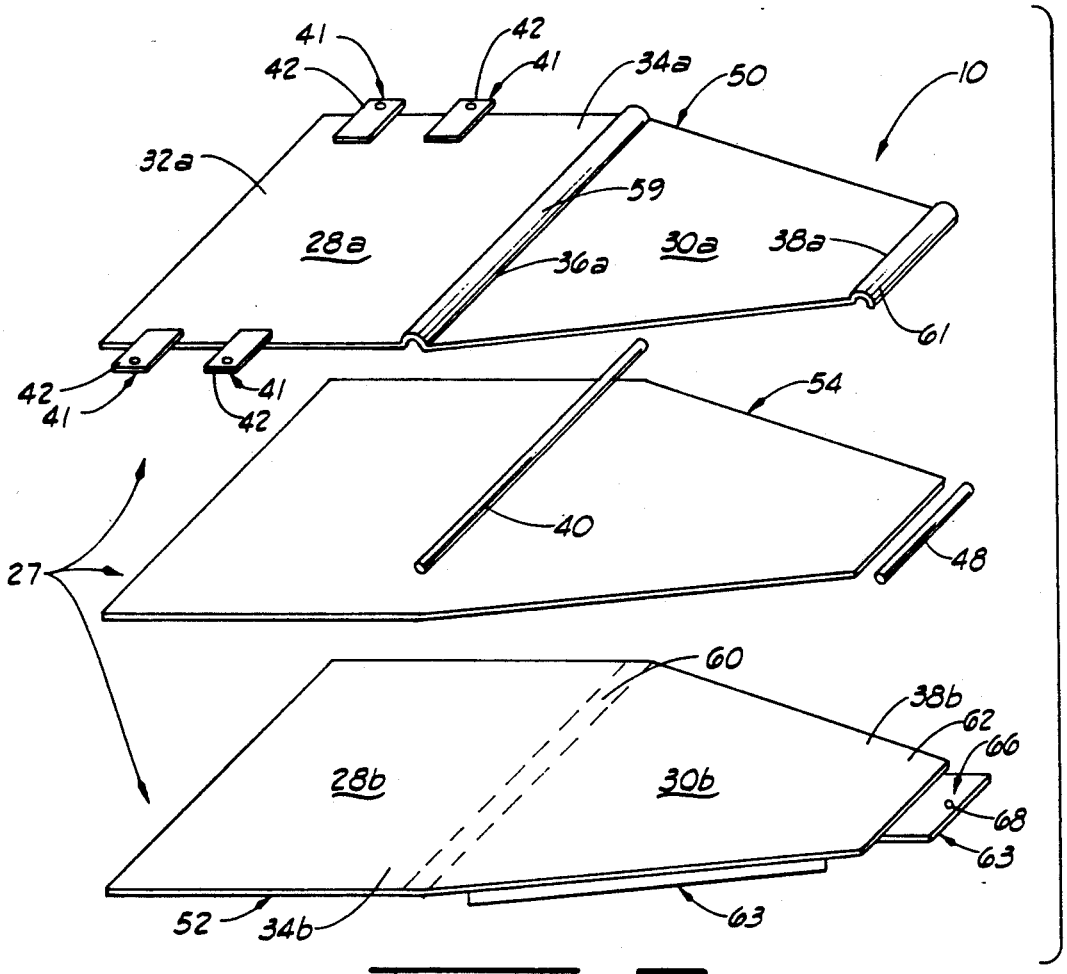
FIG. 3 is a perspective view of the companionway enclosure assembly of FIG. 2 shown substantially unassembled.

To maintain the door portion 30 of the flexible cover 27 in a companionway enclosing position when the door portion 30 is extended over the side portion 20 of the companionway 12, a weight member 48 is connected to the second end 38 of the door portion 30. The weight member 48 exerts a downwardly directed force on the door portion 30 of the flexible cover 27 so as to maintain the door portion 30 in a side portion enclosing position as illustrated in FIG. 1. Further, the weight member 48 cooperates with the support rod 40 to maintain the awning portion 28 of the flexible cover 27 in the desired hatch covering position. Referring now to FIG. 3, the companionway enclosure assembly 10 is shown in a disassembled condition in order to more clearly illustrate various components of the companionway enclosure assembly 10. The flexible cover 27 of the companionway enclosure assembly 10 comprises a first layer 50, a second layer 52 and an intermediately disposed insulation layer 54. The first and second layers 50, 52 form the exterior surfaces of the companionway enclosure assembly 10 and are desirably fabricated of a water impervious, ultraviolet radiation resistant material to repel any moisture which should come in contact with the companionway enclosure assembly 10 and to resist deterioration due to exposure to the sun.

The first and second layers 50, 52 are each provided with a configuration so as to cover and extend over the entire hatch portion 18 and the side portion 20 of the companionway 12. It should be noted that not all companionways are shaped and dimensioned the same, but vary depending on the particular make and model of the boat. Therefore, the configuration of the companionway enclosure assembly 10, and thus the shape and size of the first and second layers 50, 52 is dependent on the configuration of the companionway 12 which is enclosed by the companionway enclosure assembly 10.

When constructing the companionway enclosure assembly 10 the first layer 50 is desirably provided with a length greater than the second layer 52 so that when the first and second layers 50, 52 are connected a loop 56 is formed along the second end 34 of the awning portion 28 of the flexible cover 27 and a loop 58 is formed at the second end 38 of the door portion 30 of the flexible cover 27 substantially as shown in FIG. 2. That is, a loop portion 59 found along a second end 34A of an awning portion 28A of the first layer 50 and a substantially flat portion 60 provided along a second end 34B of an awning portion 28B of the second layer 52 cooperate to define the loop 56 which serves as a housing for the support rod 40 so that the support rod 40 is maintained in a traverse position relative to an elongated axis of the flexible cover 27 along the second end 34 of the awning portion 28. Similarly, the loop 58 (FIGS. 1 and 2) at the second end 38 of the door portion 30 (which defines a housing for the weight member 48) is found by a loop portion 61 found along a second end 38A of a door portion 30A of the first layer 50 and a substantially flat portion 62 provided along a second end 38B of a door portion 30B of the second layer 52.

The loop portion 59 of the first layer 50 is dimensioned to extend over the support rod 40 so as to permit the second layer 52 to lay flat when the support rod 40 is disposed within the loop 56 formed by the loop portion 59 of the first layer 50 and the flat portion 60 of the second layer 52. Such a configuration insures that the flexible cover 27 will remain in contact with the cabin trunk 22 when the companionway enclosure assembly 10 is connected to the cabin trunk 22 and disposed to extend over the companionway 12.

As previously mentioned hereinabove, the support rod 40 maintains the flexible cover 27 in an extended position, and the positioning of the support rod 40 relative to the hatch portion 18 and the side portion 20 is particularly important for maintaining the awning portion 28 of the flexible cover 27 in an extended, taut position. To properly position the support rod 40 relative the the hatch portion 18 and the side portion 20, the awning portion 28 is dimensioned so that the first end 32 of the awning portion 28 of the flexible cover 27 extends over the rear end 26 of the hatch cover 25 and the second end 34 of the awning portion 28, which includes the support rod 40, extends over the edge of the hatch portion 18 as shown in FIG. 1. By positioning the support rod 40 over the edge of the hatch portion 18, the weight of the support rod 40 pulls the awning portion 28 taut, thereby maintaining the awning portion 28 in the extended position.

The support rod 40 and the weight member 48 can be constructed of any suitable material, provided that such material is rigid and relatively light in weight in order to support and maintain the flexible cover 27 in an extended position over the companionway 12 while at the same time allowing the companionway enclosure assembly 10 to be easily handled and transported.

To enhance the thermal insulating capability of the companionway enclosure assembly 10, the insulation layer 54 is interposed between the first and second layers 50 and 52 of the flexible cover 27. The insulation layer 54 can be composed of any flexible material having good insulating properties, such a polyethylene.

Figure 4:
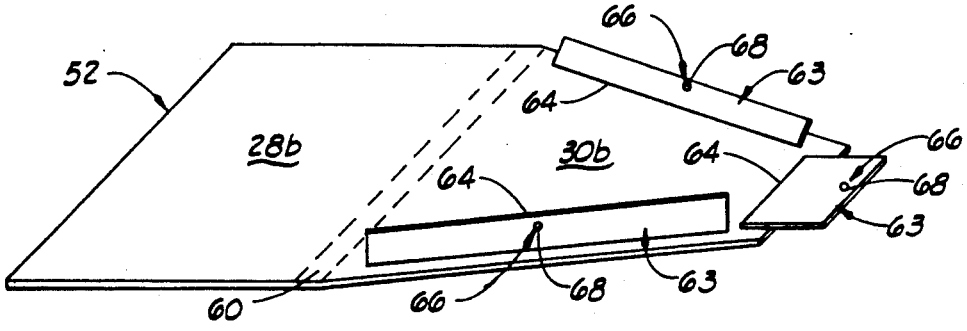
FIG. 4 is a perspective view of a cabin facing side of a second layer of the companionway enclosure assembly of FIG. 2, illustrating the positioning of retaining flaps.

To eliminate drafts from the cabin, the flexible cover 27 of the companionway enclosure assembly 10 further includes a plurality of retaining flaps 63 (FIGS. 2–4). The retaining flaps 63 cooperate to retain the door portion 30 over the companionway 12, thus preventing the door portion 30 from swinging or flapping open in the wind. The retaining flaps 63 are connected along an inner edge portion 64 to the periphery of the door portion 30B of the second layer 52 of the flexible cover 27 so that the retaining flaps 63 are movable outwardly from the second layer 52.

When securing the companionway enclosure assembly 10 in a covering position over the companionway 12 of the boat 14 as illustrated in FIG. 1, the retaining flaps 63 are disposed inwardly in the direction of the cabin so that the retaining flaps 63 are positioned adjacent the portion of the cabin trunk 22 defining the sides and bottom of the companionway 12. Thus, a resistance is created which prevents the door portion 30 of the flexible cover 27 from swinging outwardly relative to the cabin.

To enhance the stability of the door portion 30 of the flexible cover 27, as well as to more securely retain the door portion 30 over the side portion 20 of the companionway 12, the retaining flaps 63 are desirably provided with snap fasteners 66 (FIG. 4). The snap fasteners 66 are conventional fasteners and include a female or snap portion 68 and a male or base portion (not shown). At least one of the female or snap portion 68 of the snap fasteners 66 is connected to each of the retaining flaps 63, while the mating male or base portion (not shown) of each of the snap fasteners 66 is mounted on the inside of the cabin trunk 22 adjacent the sides and bottom of the companionway 12 in a conventional manner so as to be matingly aligned with each female or snap portion 66. The retaining flaps 63 (in combination with snap fasteners 66) produce a relatively air-tight seal around the companionway 12, thereby eliminating virtually all drafts.

As previously stated, the insulation layer 54 is disposed between the first layer 50 and the second layer 52 of the flexible cover 27. Thus, in fabricating the companionway enclosure assembly 10 of the present invention, the insulation layer 54 is positioned between the first and second layers 50, 52 and the first layer 50 is then connected to the second layer 52 by any suitable means, such as by sewing or the like. When the first and second layers 50 and 52 are sewn together, the durability of the companionway enclosure assembly 10 will be increased if thread which is resistant to water and ultraviolet radiation is used.

As mentioned hereinabove, the first layer 50 is connected to the second layer 52 so as to form the loop 56 and the loop 58. The loop 56 is formed by gathering material at the second end 34A of the awning portion 28A of the first layer 50 so that the loop portion 59 is formed substantially as shown in FIG. 3. The first layer 50 is then connected to the second layer 52 so that the loop portion 59 remains unattached to the flat portion 60 of the second layer 52.

The loop 58 is formed by gathering material at the second end 38A of the door portion 30A of the first layer 50 so that the loop portion 61 is formed. The first layer 50 is then connected to the second layer 52 so that the loop 58 is formed by the loop portion 61 of the first layer 50 and the flat portion 62 of the second layer 52. Once the support rod 40 and the weight member 48 have been positioned within the housing defined by the loops 56, 58 respectively, the ends of the loops 56 and 58 can be closed, if desired, in order to confine the support rod 40 and the weight member 48 therein.

Figure 5:
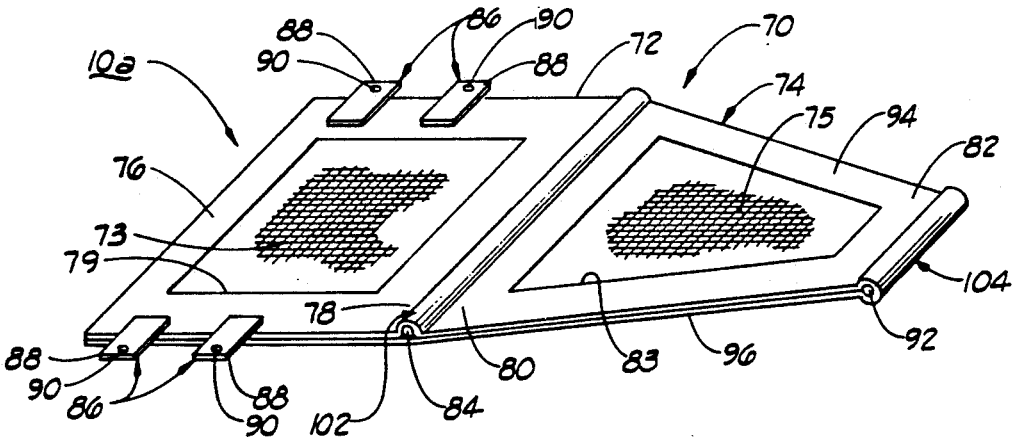
FIG. 5 is a perspective view of another embodiment of the companionway enclosure assembly of the present invention wherein the companionway enclosure assembly is illustrated in an extended position.
Figure 6:
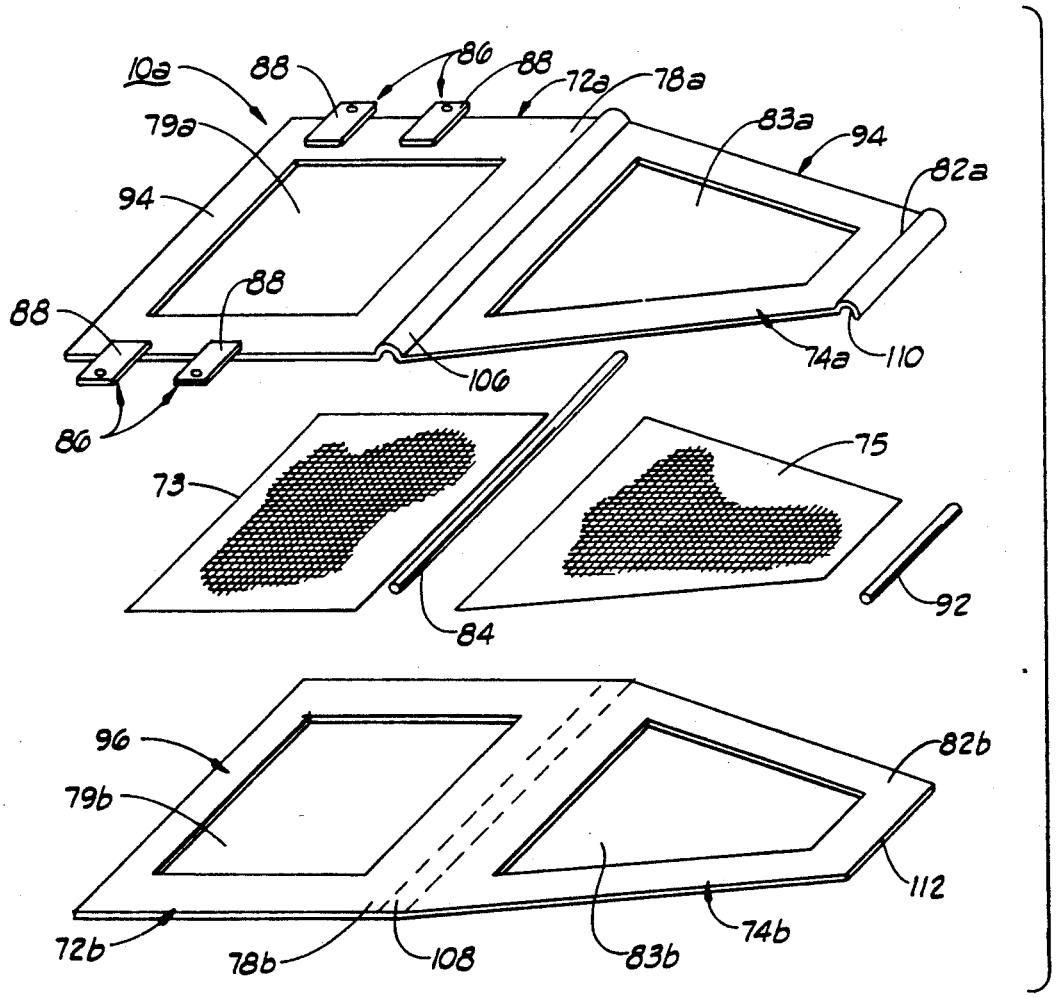
FIG. 6 is a perspective view of the companionway enclosure assembly of FIG. 5 shown substantially unassembled.

Referring now to FIGS. 5 and 6, a second embodiment of a companionway enclosure assembly 10A of the present invention is illustrated. The companionway enclosure assembly 10A is constructed and operated similarly to the companionway enclosure assembly 10; with the exception that the companionway enclosure assembly 10A is constructed and operated to function primarily as a bug screen rather than as an insulated companionway enclosure. Because of the similarities in construction and operation, the companionway enclosure assembly 10A will be described hereinbelow by making reference to the boat 14 of FIG. 1 and the relative numbered parts thereof.

The companionway enclosure assembly 10A is characterized as a flexible cover 70 comprising an awning portion 72 having a screen member 73 and a door portion 74 having a screen member 75. The screen members 73, 75 permit circulation of air into the cabin, while also providing a barrier against insects.

The awning portion 72 of the flexible cover 70 is characterized as having a first end 76, a second end 78 and an opening 79; and the door portion 74 is also characterized as having a first end 80, a second end 82 and an opening 83. The awning portion 72 is substantially rectangularly shaped and dimensioned so as to be extendible over the similarly shaped hatch portion 18 of the companionway 12; whereas, the door portion 74 is substantially trapazodially shaped and dimensioned so as to be extendible over the similarly shaped side portion 20 of the companionway 12.

The awning portion 72 and the door portion 74 of the flexible cover 70 are separated by a support rod 84 which is dimensioned to traverse the width of the flexible cover 70 so that the ends of the support rod 84 rest against the cabin trunk 22, thereby supporting and maintaining the flexible cover 70 in an extended position over the companionway 12. The positioning of the support rod 84 relative to the hatch portion 18 and the side portion 20 of the companionway 12 is important to maintaining the awning portion 72 of the flexible cover 70 in a stretched, covering position relative to the hatch portion 18 of the companionway 12 which will be described in detail hereinafter.

The companionway enclosure assembly 10A is secured to the cabin trunk 22 so that the flexible cover 70 encloses the companionway 12, while at the same time permitting easy access to the cabin (not shown) of the boat 14. That is, the flexible cover 70 can be disposed in a companionway closing position (similar to the flexible cover 27 illustrated in FIG. 1) or the flexible cover 70 can be disposed on the cabin trunk 22 so that substantially unrestricted access is provided to the cabin of the boat 14 via the companionway 12.

To secure the flexible cover 70 to the cabin trunk 22, the companionway enclosure assembly 10A is provided with a plurality of connector assemblies 86 having a connector flap 88. The connector assemblies 86 are identical in construction to the connector assemblies 41 of the companionway enclosure assembly 10 and need not be described in detail beyond the following.

Each of the connector flaps 88 is provided with a latch hole 90 disposed therethrough adapted to receive a latching member similar to the latching member 44 shown in FIGS. 7 and 8. A reinforcing element (not shown) which is also similar to the reinforcing element 46 of FIGS. 7 and 8, is disposed about each of the latch holes 90.

The connector flaps 88 extend outwardly from the awning portion 72 of the flexible cover 70 such that the latch holes 90 extend over the edge of the flexible cover 70 substantially as shown in FIG. 5. The connector flaps 88 can be fabricated as an integral portion of the flexible cover 70, or the connector flaps 88 can be fabricated as separate elements and secured to the awning portion 72 of the flexible cover 70 by any suitable means, such a by sewing and the like.

The connector flaps 88 are connected to the cabin trunk 22 adjacent the hatch portion 18 of the companionway 12 by the latching members (not shown) which are mounted to the top of the cabin trunk 22. The latching members, which are similar to the latching member 44, can be any suitable device capable of connecting the awning portion 72 of the flexible cover member 70 to the cabin trunk 22. However, desirable results have been obtained by using conventional turnbuttons.

To maintain the door portion 74 of the flexible cover 70 in a companionway enclosing position when the door portion 74 is extended over the side portion 20 of the companionway 12, a weight member 92 is connected to the second end 82 of the door portion 74 so as to exert a downwardly directed force on the door portion 74 and maintain the door portion 74 in the companionway enclosing position in a similar manner to the flexible cover 27 illustrated in FIG. 1. Thus, the weight member 92 cooperates with the support rod 84 to maintain the awning portion 72 and the door portion 74 of the flexible cover 70 in the desired companionway covering position.

Referring now to FIG. 6, the companionway enclosure assembly 10A is shown in a disassembled condition in order to more clearly illustrate various components of the companionway enclosure assembly 10A. The flexible cover 70 of the companionway enclosure assembly 10A comprises a first layer 94, a second layer 96 and the screen members 73 and 75. The first and second layers 94, 96 are each provided with a configuration so as to cover and extend over the entire hatch portion 18 and the side portion 20 of the companionway 12. It should be noted that not all companionways are shaped and dimensioned the same, but vary depending on the particular make and model of the boat. Thus, the configuration (i.e., the shape and size) of the first and second layers 94, 96 is dependent on the shape and size of the particular companionway which is enclosed by the companionway enclosure assembly 10A.

When constructing the companionway enclosure assembly 10A the first layer 94 is desirably provided with a length greater than the second layer 96 so that a loop 102 is formed along the second end 78 of the awning portion 72 of the flexible cover 70 and a loop 104 is formed at the second end 82 of the door portion 74 of the flexible cover 70 substantially as shown in FIG. 5. That is, a loop portion 106 formed along a second end 78A of an awning portion 72A of a first layer 94A; and a substantially flat portion 108 provided along a second end 78B of an awning portion 72B of the second layer 96 cooperate to define the loop 102 which serves as a housing for the support rod 84 so that the support rod 84 is maintained in a traverse position relative to an elongated axis of the flexible cover 70 along the second end 78 of the awning portion 72. Similarly, the loop 104 at the second end 82 of the door portion 74 (which defines a housing for the weight member 92) is found by a loop portion 110 formed along a second end 82A of a door portion 74A of the first layer 94 and a substantially flat portion 112 provided along a second end 82B of a door portion 74B of the second layer 96.

The loop portion 106 of the first layer 94 is dimensioned to extend over the support rod 84 so as to permit the second layer 96 to lay flat when the support rod 84 is disposed in the loop 102 formed by the loop portion 106 of the first layer 94 and the flat portion 108 of the second layer 96. Such a configuration insures that the flexible cover 70 will remain in contact with the cabin trunk 22 when the companionway enclosure assembly 10A is connected to the cabin trunk 22 and disposed to extend over the companionway 12.

As previously mentioned hereinabove, the support rod 84 maintains the flexible cover 70 in an extended position, and the positioning of the support rod 84 relative to the hatch portion 18 and the side portion 20 is particularly important for maintaining the awning portion 72 of the flexible cover 70 in an extended, taut position. To properly position the support rod 84 relative to the hatch portion 18 and the side portion 20, the awning portion 72 is dimensioned so that the first end 76 of the awning portion 72 of the flexible cover 70 extends over the rear end 26 of the hatch cover 25 and the second end 78 of the awning portion 72, and thus the support rod 84, extend over the edge of the hatch portion 18 in a manner similar to that shown in FIG. 1. By positioning the support rod 84 over the edge of the hatch portion 18, the weight of the support rod 84 pulls the awning portion 72 taut, thereby maintaining the awning portion 72 in the extended position.

The support rod 84 and the weight member 92 can be constructed of any suitable material, provided that such material is rigid and relatively light in weight in order to support and maintain the flexible cover 70 in an extended position over the companionway 12, while at the same time allowing the companionway enclosure assembly 10A to be easily handled and transported. As shown in FIG. 6, the first layer 94 of the flexible cover 70 is provided with an opening 79A in the awning portion 72A and an opening 83A in the door portion 74A. Similarly, the second layer 96 of the flexible cover 70 is provided with an opening 79B in the awning portion 72B and an opening 83B in the door portion 74B. Thus, when the first layer 94 is disposed over the second layer 96 and connected thereto, the openings 79A and 79B in the awning portions 72A, 72B of the first and second layers 94, 96 are aligned and cooperate to define the opening 79 in the awning portion 72 of the flexible cover 70. Similarly, the openings 83A and 83B in the door portions 74A, 74B of the first and second layers 94, 96 are aligned and cooperate to define the opening 83 in the door portion 74 of the flexible cover 70. The openings 79A and 79B as well as the openings 83A and 83B are dimensioned to provide the openings 79 and 83 in the awning portion 72 of the door portion 74 of the flexible cover 70 with desired dimensions so as to allow a sufficient volume of air to flow into the cabin, while at the same time providing structural integrity to the flexible cover 70.

The screen members 73, 75 are interposed between the first and second layers 94, 96 of the flexible cover 70 and are dimensioned to have a size greater than the openings 79A, 79B in the awning portion 72 and the openings 83A, 83B in the door portion 74 of the flexible cover 70. That is, the screen members 73, 75 are of sufficient size to cover the openings 79 and 83 formed in the awning portion 72 and the door portion 74 of the flexible cover 70 so that the screen members 73, 75 also function as a barrier to insects. Thus, the first and second screen members 73 and 75 are dimensioned so that the first and second screen members 73 and 75 can be secured to the awning portions 72A and 72B and the door portions 74A and 74B of the first and second layers 94, 96 of the flexible cover 70 by any suitable means, such as sewing or the like.

The screen members 73, 75 are preferably made of a durable light weight, waterproof material; and the mesh of the screen members 73, 75 is such that the screen members 73, 75 provide a barrier against small insects, such as mosquitoes. To insure that strength and durability of the flexible cover 70 is maintained, the first and second layers 94, 96 of the flexible cover 70 are preferably constructed of a water impervious, ultraviolet radiation resistant material to repel any moisture which should come in contact with the flexible cover 70 and to resist deterioration due to exposure to the sun.

The companionway enclosure assembly 10A is assembled as shown in FIG. 5 by interposing the screen members 73, 75 between the first and second layers 94, 96 and securing the screen members 73, 75 as described hereinabove. Thereafter, the first layer 94 is attached to the second layer 96 in any suitable manner such as by sewing. If the first and second layers 94, 96 are sewn together, the durability of the flexibility cover 70 will be increased if the thread employed is water and ultraviolet radiation resistant.

As mentioned hereinabove, the first and second layers 94, 96 of the flexible cover 70 cooperate to form the loops 102, 104. That is, the loop 102 is formed by gathering material of the awning portion 72A of the first layer 94 along the second end 78A thereof and connecting the first layer 94 to the second layer 96 such that the material defining the loop portion 106 remains unattached to the second layer 96. Similarly, the loop 104 is formed by gathering material at the second end 82A of the door portion 74A of the first layer 94 so that the loop portion 110 is formed. The first layer 94 is then connected to the second layer 96 so that the loop 104 is formed by the loop portion 110 of the first layer 94 and the flat portion 112 of the second layer 96. The resulting loops 102, 104 (which serve as housing for the support rod 84 and the weight member 92, respectively) can be sealed if desired, by any suitable means, such as sewing so as to secure the support rod 84 and the weight member 92 within the loops 102, 104.

The companionway enclosure assembly 10A is shown herein as not having retaining flaps for retaining the companionway enclosure assembly 10A over the companionway 12. However, it is to be understood by those skilled in the art that retaining flaps can be connected to the flexible cover 70 if desired in the same manner that the retaining flaps 63 are connected to the door portion 30B of the second layer 52 of the flexible cover 27.

Because the connector assemblies of the companionway enclosure assemblies 10 and 10A are identical in construction and because the operation of the companionway enclosure assemblies 10 and 10A are identical, with the exception of the companionway enclosure assembly 10 having the retaining flaps 63 which are pulled into the cabin for retaining the flexible cover 27 over the companionway 12 and which have already been described in detail hereinabove, only the connector assembly 41 of the companionway enclosure assembly 10 will be further described in detail with reference to FIGS. 1, 7 and 8.

As previously mentioned, each of the connector assemblies 41 include the connector flap 42 having the latch hole 43 reinforced with the reinforcing element 46, and the latching member 44. The connector flaps 42 are connected to the awning portion 28 of the flexible cover 27 such that the latch hole 43 extends over the edge of the flexible cover 27 (FIG. 7). As previously stated, the connector flaps 42 can be attached to the awning portion 28 of the flexible cover 27 by any suitable means, such as by sewing.

The latching member 44 is shown herein as a turnbutton 128. The turnbutton 128 is of conventional construction and need not be described in detail beyond the following. The turnbutton 128 has a base 130 and an oblong button 132 rotatable on a shaft 134. The turnbutton 128 is secured to the top of the cabin trunk 22 adjacent the side of the hatch portion 18 of the companionway 12 by any suitable means, such as screws 136 and 138. The proper positioning of the turnbutton 128 on the cabin trunk 22 is important for maintaining the flexible cover 27, particularly the awning portion 28 of the flexible cover 27, in a stretched taut condition when the companionway enclosure assembly 10 is secured and extended over the companionway 12. Maintaining the flexible cover 27 in a stretched condition is important for insuring that the companionway enclosure assembly 10 remains extended over the entire companionway 12. That is, the flexible cover 27 must remain taut so as not to allow water to collect, and in turn, flow around the edges of the flexible cover 27 and into the cabin. If the turnbuttons 128 are positioned so that too much slack remains in the awning portion 28 of the flexible cover 27 when the connector flaps 42 are secured thereto, a depression will form on the awning portion 28 of the flexible cover 27, thus creating a place for water to collect on top of the awning portion 28. Consequently, the turnbuttons 128 must be mounted on the top of the cabin trunk 22 adjacent the hatch portion 18 of the companionway 12 in a position which enables the awning portion 28 to remain taut so that water will run off the awning portion 28 instead of collecting thereon. Water runoff is further promoted by positioning the turnbuttons 128 such that the first end 32 of the awning portion 28 extends over the rear end 26 of the sliding hatch cover 25 when the hatch cover 25 is in the open position (as shown in FIG. 1), thereby elevating the first end 32 of the awning portion 28 to create an incline which slopes toward the second end 34 of the awning portion 28. Extending the first end 32 of the awning portion 28 over the rear end 26 of the hatch cover 25 also enables the hatch cover 25 to be moved to a closed position when the companionway enclosure assembly 10 is secured and extended over the companionway 12.

From the above description it is clear that the present invention is well adapted to carry out the objects and to attain the ends and advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A companionway enclosure assembly for enclosing a companionway of a boat in which the companionway has a hatch portion and a side portion, the companionway enclosure assembly comprising:

a flexible cover comprising an awning portion and a door portion, the awning portion extendible over the hatch portion of the companionway and having a first end and a second end, the door portion extendible over the side portion of the companionway and having a first end and a second end;

connector means for connecting the awning portion of the flexible cover to the boat adjacent the hatch portion of the companionway;

support means for supporting and maintaining the awning portion of the flexible cover in a taut position over the hatch portion of the companionway when the flexible cover is extended over the companionway, the support means traversing the width of the flexible cover and separating the awning portion from the door portion; and weight means attached to the second end of the door portion for maintaining the door portion in a stretched out condition when the door portion is extended over the side portion of the companionway.

2. The companionway enclosure assembly of claim 1 further comprising:

retaining means for retaining the door portion of the flexible cover in a fixed position over the side portion of the companionway.

3. The companionway enclosure assembly of claim 2 wherein the flexible cover is water impervious.

4. The companionway enclosure assembly of claim 3 wherein the flexible cover comprises a first and a second layer, the first layer constituting an exterior side of the flexible cover and the second layer constituting an interior side of the flexible and wherein the flexible cover further comprises:

insulating means disposed between the first and second layers for thermally insulating the flexible cover.

5. The companionway enclosure assembly of claim 4 wherein the insulating means comprises:

a thermal insulating layer.

6. The companionway enclosure assembly of claim 1 further comprising:

first loop means supported by the flexible cover for housing the support means, the first loop means disposed between the awning portion and the door portion of the flexible cover.

7. The companionway enclosure assembly of claim 6 further comprising:

second loop means supported by the second end of the door portion of the flexible cover for housing the weight means.

8. The companionway enclosure assembly of claim 1 wherein one of the awning portion and the door portion of the flexible cover is provided with a first air passage opening extending therethrough, and wherein the companionway enclosure assembly further comprises:

a first screen connected to the flexible cover so as to traverse the first air passage opening, the first screen permitting passage of air therethrough while providing a barrier against the passage of insects therethrough.

9. The companionway enclosure assembly of claim 8 when the flexible cover is provided with a second air passage opening extending through the other of the awning portion and the door portion, and wherein the flexible cover further comprises:

a second screen connected to the flexible cover so as to traverse the second air passage opening, the second screen permitting passage of air therethrough while providing a barrier against the passage of insects therethrough.

10. The companionway enclosure assembly of claim 9 further comprising:

first loop means supported by the flexible cover for housing the support means, the first loop means disposed between the awning portion and the door portion of the flexible cover.

11. The companionway enclosure assembly of claim 10 further comprising:

second loop means supported by the second end of the door portion of the flexible cover for housing the weight means.

* * * * *

UNITED STATES PATENT AND TRADEMARK OFFICE

CERTIFICATE OF CORRECTION

PATENT NO. : 5,195,445

DATED : March 23, 1993

INVENTOR(S) : Marilyn S. Riddles & Steven W. Riddles

It is certified that error appears in the above-indentified patent and that said Letters Patent is hereby corrected as shown below:

Cover Page (56) References Cited: after "Raynor", delete "115/201R" and substitute therefor --114/201R--;

Column 4, line 53, after "position." begin a new paragraph with "Referring"; and Column 9, line 46, after "transported." begin a new paragraph with "As".

Signed and Sealed this

Twenty-sixth Day of April, 1994

*Attest:*

Bruce Lehman

BRUCE LEHMAN

*Attesting Officer*

*Commissioner of Patents and Trademarks*